US007316501B2

(12) United States Patent
Thoma

(10) Patent No.: US 7,316,501 B2
(45) Date of Patent: Jan. 8, 2008

(54) APPARATUS AND METHOD FOR MIXING DISSIMILAR FLUIDS

(76) Inventor: Christian Thoma, The Court House, La Grande Route des Sablons, Fauvic, Grouville, Jersey (GB) JE3 9FG ( * ) Notice: Subject to any disclaimer, the term of this patent is extended or adjusted under 35 U.S.C. 154(b) by 434 days.

(21) Appl. No.: 10/849,464

(22) Filed: May 20, 2004

(65) Prior Publication Data

US 2005/0259510 A1 Nov. 24, 2005

(51) Int. Cl.
*B01F 15/00* (2006.01)

(52) U.S. Cl. ..... 366/168.1; 366/181.4; 366/328.1

(58) Field of Classification Search ..... 366/169.1, 366/169.2, 170.3, 170.4, 325.93, 328.2, 328.4, 366/328.1, 168.1
See application file for complete search history.

(56) References Cited

U.S. PATENT DOCUMENTS 1,885,283 A * 11/1932 Ostermann ..... 241/247
2,969,960 A * 1/1961 Gurley, Jr. ..... 366/303
4,302,409 A * 11/1981 Miller et al. ..... 264/45.9
4,388,915 A * 6/1983 Shafran ..... 126/247
4,416,548 A * 11/1983 Carre et al. ..... 366/171.1
4,419,014 A * 12/1983 Gale ..... 366/99
4,421,413 A * 12/1983 Sekiguchi ..... 366/307
4,479,884 A * 10/1984 Clarke et al. ..... 510/153
4,517,107 A * 5/1985 Clarke et al. ..... 510/483
4,595,546 A * 6/1986 Wheeler, Jr. ..... 264/83
4,913,556 A * 4/1990 Schroter et al. ..... 366/305
5,013,233 A * 5/1991 Semmekrot ..... 425/208
5,141,328 A 8/1992 Dilley
5,188,090 A * 2/1993 Griggs ..... 126/247
5,205,647 A * 4/1993 Ricciardi ..... 366/328.2

(Continued)

FOREIGN PATENT DOCUMENTS

DE 33 27 137 2/1984

(Continued)

*Primary Examiner*—Tony G. Soohoo
(74) *Attorney, Agent, or Firm*—Young & Thompson

(57) ABSTRACT

An apparatus and method for fluid mixing comprising a housing having an internal chamber and a rotatable unit disposed in the chamber. Sufficient clearance is provided between the rotatable unit and the housing to create space for the mixing of the two or more dissimilar fluids. As one example, one fluid input arrives in the mixing chamber by suitable ducting in the housing and the other fluid input arrives in the mixing chamber via a passage in the rotatable unit, the fluids collide and mix and where preferably at least one array of surface irregularities are disposed on an exterior face of the rotatable unit. The refined fluid mixture leaves the apparatus from a exit in the housing preferably poritioned radially outwardly of the rotatable unit.

1 Claim, 13 Drawing Sheets

U.S. PATENT DOCUMENTS

| | | | | |
|---|---|---|---|---|
| 5,385,298 | A | 1/1995 | Griggs | |
| 5,490,727 | A | 2/1996 | Poschl | |
| 5,538,343 | A * | 7/1996 | Tynan | 366/305 |
| 5,552,133 | A | 9/1996 | Lambert et al. | |
| 5,957,122 | A | 9/1999 | Griggs | |
| 6,013,222 | A * | 1/2000 | Douglas et al. | 264/514 |
| 6,345,907 | B1 * | 2/2002 | Akay et al. | 366/99 |
| 6,386,751 | B1 * | 5/2002 | Wootan et al. | 366/170.3 |
| 6,595,759 | B2 * | 7/2003 | Crosta et al. | 417/63 |
| 6,627,784 | B2 | 9/2003 | Hudson et al. | |
| 6,869,212 | B2 * | 3/2005 | Uesugi et al. | 366/164.6 |
| 6,974,305 | B2 * | 12/2005 | Garrett, III | 415/230 |
| 7,011,745 | B1 * | 3/2006 | Moulton | 210/150 |
| 7,089,886 | B2 * | 8/2006 | Thoma | 122/26 |
| 7,121,714 | B2 * | 10/2006 | Parker Metcalfe et al. | 366/175.1 |
| 2003/0072212 | A1 * | 4/2003 | Wood et al. | 366/170.3 |
| 2005/0047270 | A1 * | 3/2005 | Wood et al. | 366/170.3 |
| 2005/0259510 | A1 * | 11/2005 | Thoma | 366/168.1 |
| 2005/0263607 | A1 * | 12/2005 | Thoma | 237/12 |
| 2006/0098528 | A1 * | 5/2006 | Wood | 366/170.3 |

FOREIGN PATENT DOCUMENTS

| | | |
|---|---|---|
| GB | 1217959 | 1/1971 |
| GB | 2142632 | 1/1985 |
| JP | 55-102491 | 8/1980 |
| JP | 60-008391 | 1/1985 |
| JP | 60-226594 | 11/1985 |
| JP | 62-213895 | 9/1987 |
| WO | 94/11096 | 5/1994 |
| WO | 99/11478 | 3/1999 |

* cited by examiner

APPARATUS AND METHOD FOR MIXING DISSIMILAR FLUIDS

BACKGROUND OF THE INVENTION

This invention relates generally to fluid mixing, and more particularly, to a method and apparatus for mixing dissimilar liquids and dissimilar fluids such as a gas and a liquid or dissimilar liquids; and specifically to those devices wherein rotating elements are employed to mix the fluid passing through them. Although there are numerous applications requiring mixing apparatus, one such application is for the clarification of waste water, where the waste water and air are to be mixed together in order that the pollutants carried in the waste water can be broken down through being decomposed by oxidation. Conventional mixing apparatus usually employ some form of shaft-driven impeller arrangement located within a chamber in which the fluids are introduced. Such apparatus, however, often provides a poor quality product mix and are therefore not always the best solution for an intended application. Other types employ rotating drums or rotors, where the fluids, initially brought together external of the apparatus, are then directed to navigate past a relatively small annular clearance between the outer static housing and the inner rotating drum where there is sufficient flow turbulence to refine the mixture or to thoroughly oxidize the pollutants carried in the mixture.

Such an example of mixing apparatus is shown in U.S. Pat. No. 6,627,784 where the two dissimilar fluids are combined together at a single pipe junction external of the machine, and distributed via two pipes to respective inlets at opposite ends of the machine. While some superficial mixing of the fluids will undoubtedly occur as they are introduced into a single pipe, the concentrated mixing occurs only as the fluids have been distributed to enter from both ends the annular clearance between rotor and housing before exiting the machine at the midway point. The rotor, by being provided with surface irregularities on its exterior generates cavitation in the liquid passing through the unit resulting in a better mixing than would be normally possible with a smooth rotor. The phenomena of cavitation is normally an occurrence best avoided in the operation of machinery, but for producing a good mixture between of fluids of dissimilar type, there are definite advantages for having such phenomena take place during operation of the machinery.

Even so, for certain applications and choice of fluids as well as such issues as when dealing with waste water, there would be an advantage if respective fluids could be first brought together in the interior of the housing rather than externally of the machine as taught by U.S. Pat. No. 6,627,784. The resulting pipe work on the input side would be simpler to install and maintain as each fluid input would have it own separate pipe connected directly to the housing. Furthermore, there would be advantage in the promotion of more effective mixing of the fluids if a majority of the exterior surface length of the rotor could be used rather than the comparable shorter distance available on the rotor of U.S. Pat. No. 6,627,784. By effectively doubling the travel distance of the fluids, a better mix is possible. There would also be an additional advantage in a device where the separate intakes for the dissimilar fluids entering into the working clearance between rotor and housing would in be quite close together, preferably arranged in a manner to lessen any likelihood of reverse flow. Reverse flow can trouble the rotor shown in U.S. Pat. No. 6,627,784, as here the fluids are entering at both ends of the annular clearance between rotor and housing and may not flow in equal measure, for instance, should there be a significant variation in the pressure drop between the two input circuits, a resulting disproportionate quantity of fluid would flow to that side where the resistance to flow is less.

There therefore is a need for a new solution for an improved fluid mixing device, and preferably where the separate fluids can be introduced to the device quite independently, and where mixing of the fluids can occur on or about the rotor surface, and where there is less likelihood for the fluid to flow in a reverse direction to that desired. For instance, were the dissimilar fluids entering the chamber of such a device separated by at least one array of surface irregularities disposed over a relatively short lengthwise distance on the surface of the rotor, an additional disturbance to the flow path of the fluids could mitigate against reverse flow conditions as one of the two fluids would first to have to traverse this distance before reaching the second fluid. In essence, the first fluid, by being subjected to the influence of cavitational disturbance induced by this initial array of surface irregularities during its transit towards meeting the second fluid, is thought to increase the general turbulence in the first fluid such that it has a greater impact once it makes contact with the second fluid. The resulting impact between the fluids, being more vigorous than would otherwise occur, when two fluids carried by separate pipes are merged, creates greater turbulence and helps in the creation of better overall fluid mix, particularly when further arrays of surface irregularities are disposed along the remaining rotor surface in the direction towards the fluid exit.

The present invention seeks to alleviate or overcome some or all of the above mentioned disadvantages of earlier machines. The device comprising few working parts and relatively simple to implement, thereby minimizing the possibility of component failure and avoiding expensive and time-consuming machine downtime, offers better regulation of the fluids entering the device to ensure a better quality of mixture of the fluid exiting the device.

SUMMARY OF THE INVENTION

It is therefore an object of the present invention to provide a new and improved fluid mixing device and method of mixing fluids that addresses the above needs.

A principal object of the present invention is to provide a novel form of fluid mixing apparatus capable of accepting dissimilar fluids at two or more quite separate input locations and capable of mixing such fluids together and thoroughly through the internal revolving componentry in the apparatus to output the combined fluid mixture at, preferably a single exit location. It is a still further object of the invention to provide a method for doing so.

It is a still further object of the invention to alleviate or overcome some or all of the above described disadvantages of earlier devices and to effect a more efficient mixing of inputed dissimilar fluids by a revolving rotor. The revolving rotor called the rotatable unit being preferably being built with at least one array of surface irregularities in the form of bottom-ended holes disposed along the surface of the rotor and preferably positioned between the respective entry points for two of the dissimilar fluids. Respective fluids on entering the annular clearance in the case of a cylindrical rotor (later referred to as the fluid passage gap region to cover other rotor forms) can be said to be initially spaced apart or separated by the spacing of the array of surface irregularities before they are able to come into contact with each other. It is therefore a preferred feature of this invention to include at least one array of surface irregularities disposed over a relatively short axial distance on the surface of the rotor and facing towards the annular clearance.

It is therefore a feature of the invention that the initially quite separate fluids inputs to the device are disposed at two quite independent entry locations, both preferably located in the housing, such the fluids combine interiorly and not exteriorly of the housing. Preferably, the fluids combine in the volumetric region bounded between the static housing and the revolving rotor on the one hand, and on the other hand, at or near to the location of the said at least one array of surface irregularities disposed on the surface on the rotor. As such, the quite separate streams of fluid entering via the housing to the internal chamber of the device can be said to be initially spaced apart at the rotor surface by this array of surface irregularities, combining fully only after one of the fluids has travelled past that distance covered by the array of surface irregularities in a direction towards the fluid output or exit of the machine. Preferably, additional arrays of bottom-end holes may be employed over the remaining surface of the rotor for improve the mixing of the fluids. If deployed, such additional arrays produce more enhanced cavitational disturbances resulting in increased agitation of the mixture as it travelling along common path towards the exit to depart the device as a refined and homogeneous mixture.

Although it is most normal that the dissimilar fluids admitted to the machine will be pressurized above atmospheric pressure in order to flow more readily through the device, it is a preferred feature of the invention to input the fluids into the chamber nearer the rotational axis of the machine and incorporate the peripheral exit for the mixture nearer towards the external diameter dimension of the rotor. It is a further preferred feature that the rotational energy imparted to each of the fluids by the revolving rotor in itself acts to help prevent the fluids flowing in the wrong direction, thus for many applications, alleviating the need for having check valves. Furthermore, the shape of the rotor may also, when required, be used as a further means to help propel the fluid mixture through the interior of the device such that less reliance may be placed on the supply pressure of the fluids. For example, by inclining the surface of the rotor with respect to the rotational axis, a small pumping effect is produced which can help the mixture move in a direction towards the periphery exit.

Various rotor shapes are disclosed in this specification and where surface irregularities are shown as parallel bottom-ended holes. However, such surface irregularities may be modified and be short-circuited back into one of the two fluid input streams to create additional cavitation in the mixing liquids. During high speed rotation of the rotor, such bottom-ended holes create low pressure zones in and about the passing liquids. The fluids are squeezed and expanded by the vacuum pressure and the condition of cavitation together with accompanying shock wave behaviour producing sufficient turbulence to ensure a good mixing between the once dissimilar fluids. In the case of municipal waste water treatment plant, as the rate at which the biological digestion of the organic matter pollutants takes place is especially dependent on the quantity of oxygen carried in the waste water, the more oxygen available in the water to sustain the activity of the micro-organisms in consuming the pollutants, the more cost-effective the process for the tax payer, and for the betterment for the environment.

In one form thereof, the invention is embodied as an apparatus for the mixing of two or more dissimilar fluids together, comprising a housing, a main chamber in said housing and a rotor disposed in said main chamber, said rotor and said main chamber defining an inlet region having first and second sub-regions, an exhaust region and a fluid mixing region. The housing supports a drive shaft and where the drive shaft has a longitudinal axis of rotation and is drivingly connected to the rotor. The housing preferably has at least two first and second fluid inlets which are in fluid communication with the inlet region; and the housing preferably also has at least one fluid outlet which is in fluid communication with the exhaust region. The first and second fluid inlets as well as the fluid outlet each are opening exteriorly of the housing. The apparatus further comprising first and second opposing fluid boundary defining surfaces spaced apart from one another along at least a majority of length of said rotor to form said fluid mixing region and a unidirectional pathway for dissimilar fluids upon entering said inlet regions to reach said exhaust region, wherein preferably the first sub-region of the inlet region lies axially adjacent the rotor and where preferably the second sub-region lies between the first and second opposing fluid boundary defining surfaces along a minority of length of the rotor.

Other and further important objects and advantages will become apparent from the disclosures set out in the following specification and accompanying drawings.

BRIEF DESCRIPTION OF THE DRAWINGS

The above mentioned and other novel features and objects of the invention, and the manner of attaining them, may be performed in various ways and will now be described by way of examples with reference to the accompanying drawings, in which.

These figures and the following detailed description disclose specific embodiments of the invention; however, it is to be understood that the inventive concept is not limited thereto since it may be incorporated in other forms.

DETAILED DESCRIPTION OF THE FIRST ILLUSTRATIVE EMBODIMENT OF THE INVENTION

Figure 1:
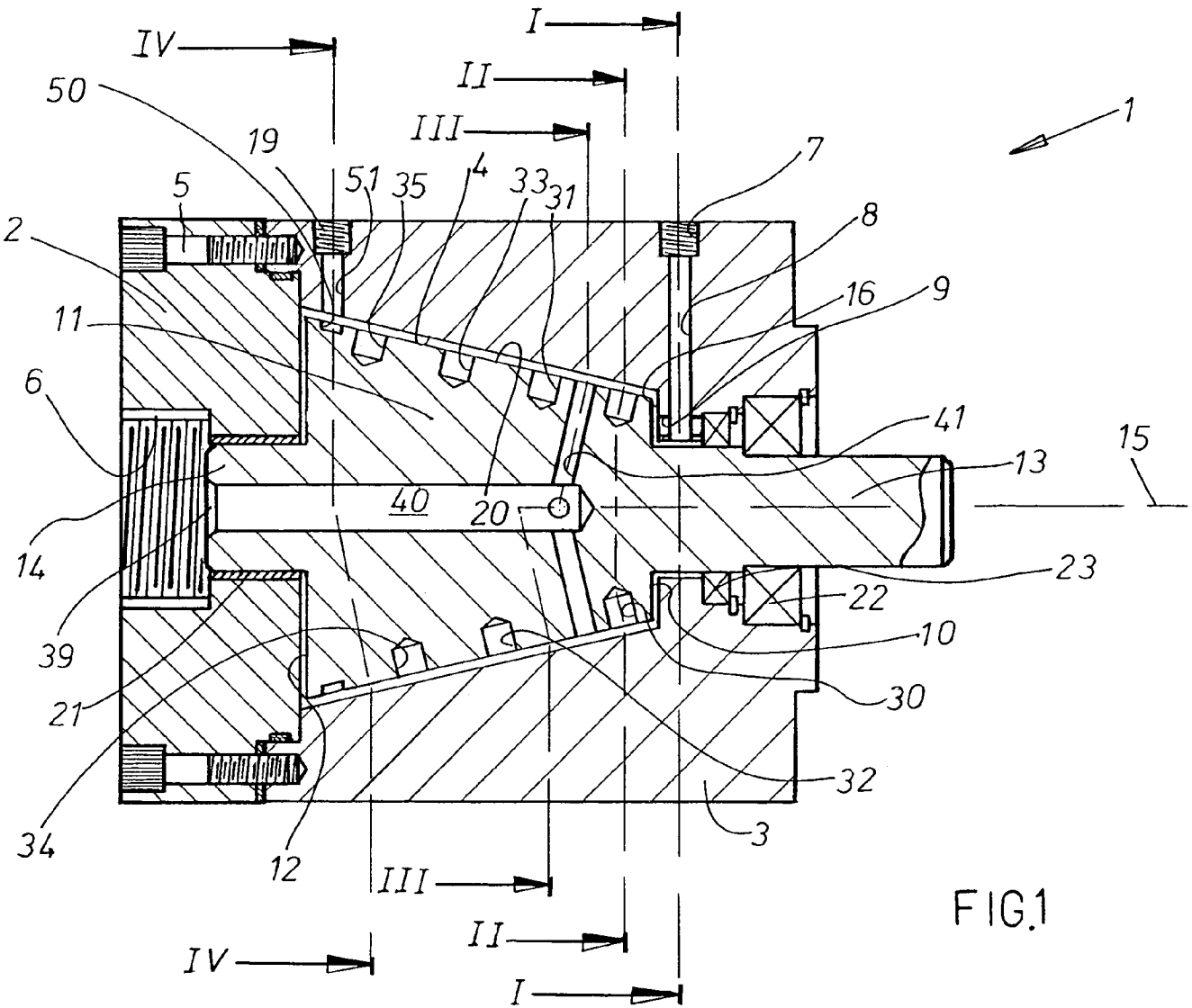
FIG. 1 is a longitudinal sectional view of a device in according to the first embodiment of the present invention.
Figure 5:
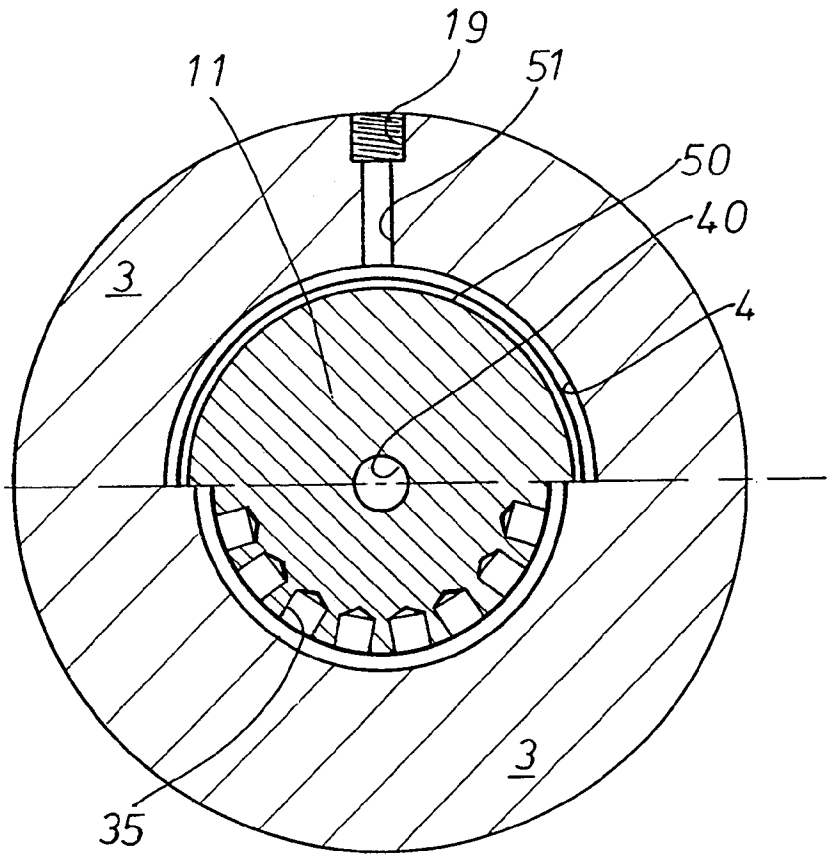
FIG. 5 is a transverse sectional view of the device taken along line IV-IV in FIG. 1.
Figure 4:
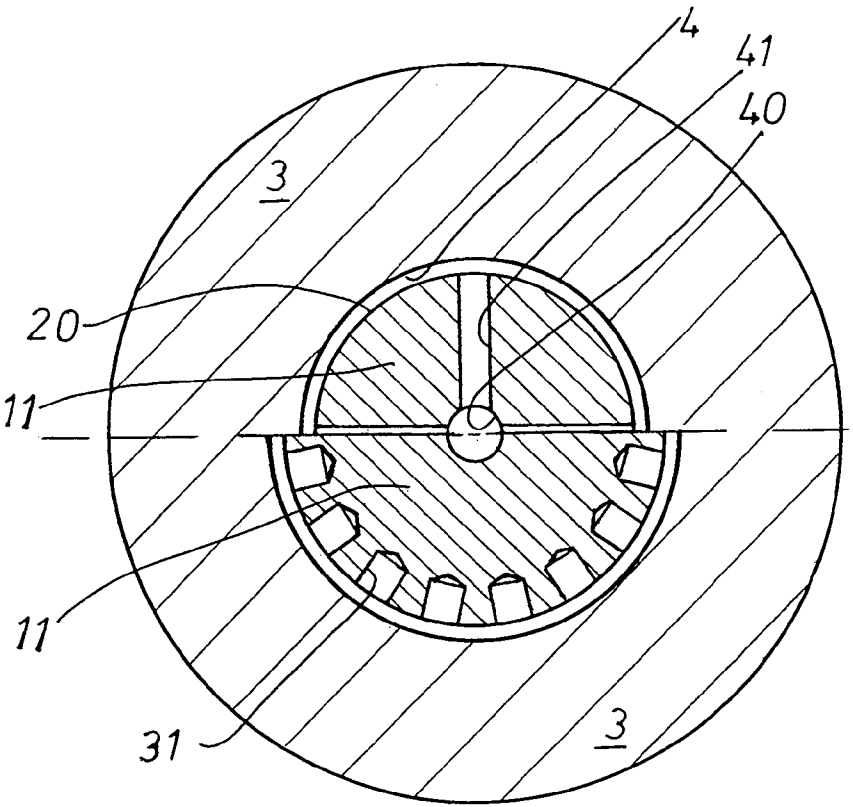
FIG. 4 is a transverse sectional view of the device taken along line III-III in FIG. 1.

Referring to FIGS. 1 and 5, the device denoted by reference numeral 1 shows a housing structure comprising a rear housing member 2 and a front housing member 3. Housing member 3 is produced with a central main bore 4 which forms the main chamber of the device 1 once housing member 2 is attached to it and the housings members 2, 3 are held together by a series of screws 5. Rear housing member 2 is provided with a threaded central fluid intake connection 6 for fluid 'A' and front housing member 3 is provided with a threaded fluid intake connection 7 for fluid 'B'.

The rotatable unit comprises a rotor portion 11 positioned in central main bore 4 and extending in length from the smaller diameter end 10 to larger diameter end 12, as well shaft portions 13, 14. Shaft portion 13 extends out from housing member 3 to provide means for driving the device 1, for instance by a prime mover such as an electric or diesel motor, whereas shaft portion 14, extending from larger diameter end 12 of rotor portion 11 and this portion 14, remains internal of the device 1. Preferably, rotatable unit, as shown, is substantially solid in construction.

Figure 2:
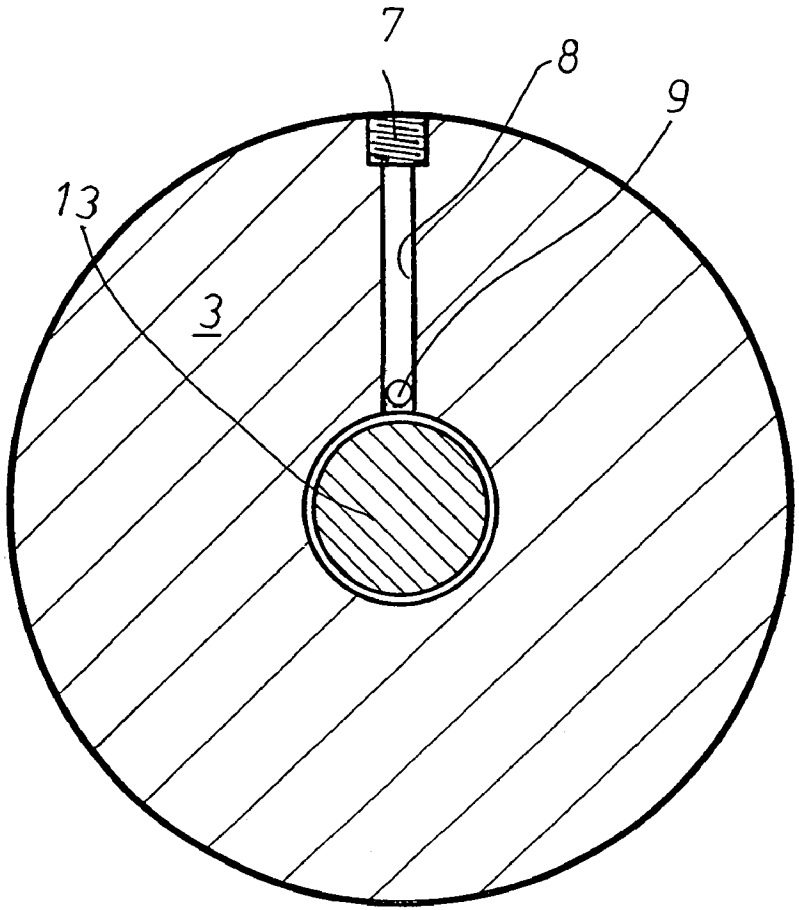
FIG. 2 is a transverse sectional view of the device taken along line I-I in FIG. 1.

FIG. 2 is a section taken at I-I in FIG. 1 and shows inlet 7 connected by passage 8 and inlet port 9 to the volumetric space adjacent the smaller diameter end 10 of rotor portion 11. That volumetric space, defined axially by the distance between the smaller diameter end face 10 of the rotor 11 and interior wall 16 of housing member 3, and radially between shaft portion 13 and bore 4, being termed for this embodiment as the first sub-region of the inlet region.

Threaded fluid exit connection 19 is provided in front housing member 3 for the departing fluid mixture 'A+B', but alternatively could be disposed in rear housing member 2 and horizontally positioned to be approximately level with bore 4.

Rotor portion 11 has exterior surface 20 sized accordingly to have the required working clearance in bore 4. Bore 4 may then be described as being the outer static member and the exterior surface 20 of rotor 11 as the rotatable inner member. As such, this embodiment uses a portion of the total length of this working clearance as a fluid mixing region, so that mixing between fluids 'A' and 'B' can take place in this region. In effect, surface 20 of the rotor 11 forms a first fluid boundary defining surface and bore 4 of the housing forms a second fluid boundary defining surface, and working clearance is the space between these first and second fluid boundary defining surfaces. In this particular embodiment, both rotor 11 and bore 4 are shown at an angle with respect to the axis of rotation 15 of the device 1. However, the inclination chosen for the two fluid boundary defining surfaces need not necessarily be of the same value, for example, one of the surfaces may remain parallel with respect to axis 15.

The rotor portion 11 and drive shaft portions 13, 14 comprising the rotatable unit is supported in the housing by a pair of bearings, bearing 21 disposed in rear housing member 2 and bearing 22 disposed adjacent rotary seal 23 in front housing member 3. The transmission of power to the device without any direct mechanical connection such as the example here depicted of an externally protruding drive shaft portion 13 would remove the requirement for such a seal. Also as shown, inlet port 9 is bored with sufficient depth so that fluid 'B' entering the inlet port 9 from passage 8 can provide coolant and lubricant to seal 23 should conditions allow. However it should be noted all embodiments may easily be adapted to incorporate other types of seals that are readily available, and as one example, a spring-loaded face seal could be used operating against rotor end face 10, and where in this case port 9 would be radially displaced slightly to connect with bore 4 at or near to the start of the taper.

Inner shaft portion 14 supported in bearing 21 may, should conditions allow, receive lubrication from fluid entering inlet 6. However, the housing member 2 could be easily modified to allow the addition of some form of sealing device at one end or both ends of this bearing 21 in order to protect the bearing from any aggressive fluid medium or contamination entering the housing member via inlet 6. Although bearing 21 is depicted as a plain bearing, it could alternatively be arranged that a ball bearing is used in its place.

Over rotor exterior surface 20, the first fluid boundary defining surface, there are preferably provided a plurality of bottom-ended holes opening on said first fluid boundary surface and having a longitudinal axes projecting in a substantially radial direction towards said axis of rotation 15. Six rows of such bottom-ended holes are shown and denoted by reference numerals as rows 30, 31, 32, 33, 34 and 35.

In the interior of the rotor and shaft portions 11, 14, there is one longitudinal passageway 40 and one or more angled radial passageways 41. An entrance port 39 is provided in the face of shaft portion 14, which allows fluid arriving from inlet 6 to pass through entrance port 39 into longitudinal passageway 40, entering via radial passageways 41, the clearance space between rotor exterior surface 20 and bore 4, and this space is called the second sub-region of the inlet region. As shown in this embodiment, the second sub-region, occupying a minority of length along the exterior 20 of rotor portion 11, also covers the distance wherein a first row of bottom-ended holes 30 are placed.

The number of rows incorporated on the rotor exterior surface 20 may be more or less than sixth rows, but normally the rototable unit would have at least one row of bottom-ended holes 30 disposed between radial passageways 41 and inlet port 9, positioned nearer the smaller diameter end 10 of the rotor portion 11.

Figure 3:
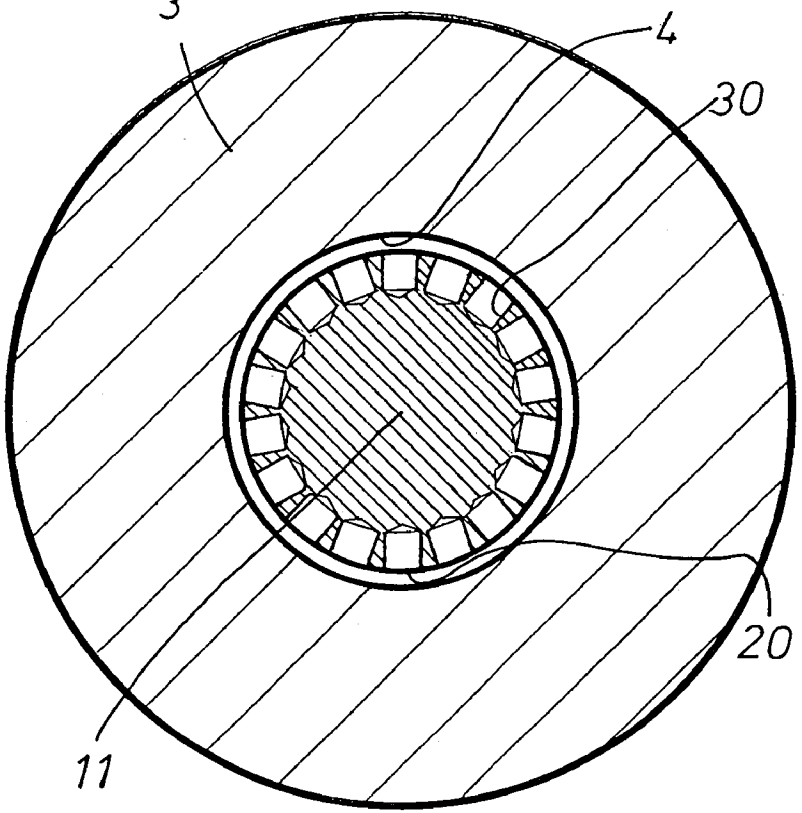
FIG. 3 is a transverse sectional view of the device taken along line II-II in FIG. 1.

FIG. 3 is a section taken at II-II across row 30 in FIG. 1 and depicts eighteen individual drilled holes that make up this particular row.

Towards the larger diameter end 12 of rotor 11, best seen in FIGS. 1 & 5, is the fluid exhaust region for the device 1. Here a circumferential groove 50 is disposed on rotor exterior surface 20 which may be usefully employed should the device be built incorporating a quite small gap height for the working clearance, say less than 0.5 mm. Circumferential groove 50 helps collect fluid mixture 'A+B' so that it can be expelled from the device via a passage 51 which communicates with fluid exit 19. The exhaust region extends from the last rows of rows to the end face 12 of the rotor portion 11.

To operate the device 1, some form of prime mover is used to provide mechanical power in the form of driving torque and rotation to rotor portion 11. Fluid 'A' entering the chamber of the device 1 through inlet 6 enters the interior of the rotor 11 by passageways 40, 41 to reach the working clearance between rotor exterior surface 20 in bore 4, called the second sub-region of the inlet region. Meanwhile, fluid 'B' enters the chamber of the device 1 through inlet 7 to flow towards the smaller diameter end 10 of rotor 11 via passage 8 and inlet port 9, called the first sub-region of the inlet region. The spinning rotor portion 11 helps in propelling fluid 'B' radially outwards towards bore 4 and fluid 'B' enters the working clearance between bore 4 and rotor exterior surface 20. Before Fluid 'B' can readily mix with fluid 'A', it must first have to transit over the spacing occupied by first group or row of bottom-ended holes 30 where it is subjected to turbulent flow conditions caused by any negative pressure regions. When such a row of bottom-ended holes is used occupying some of the spacing in the device 1 between port inlet 9 and passageways 41, the resulting turbulence in fluid 'B' improves the initial fluid mix between the dissimilar fluid once fluid 'B' collides with fluid 'A'.

Fluids 'A' and 'B' now in the mixing region then travel together further along the exterior surface 20 of the rotor in a direction towards the larger diameter end 12, and further turbulence induced to the mixture by each row, 31, 32, 33, 34, 35 in turn adds to the increasingly refined mixture. The resulting mixture arriving at circumferential groove 50 is now in the exhaust region and here it departs the chamber via passage 51 and exit connection 19.

Although this embodiment as well as a number of subsequent embodiments show a circumferential groove 50 formed on the exterior of the rotor, this space could be used to include an additional grouping or row of bottom-ended holes. Exit 19 and passage 51 in housing member 3 could be easily moved to housing member 2 and positioned facing the larger diameter end 12 of rotor 11.

DETAILED DESCRIPTION OF THE SECOND ILLUSTRATIVE EMBODIMENT OF THE INVENTION

Figure 6:
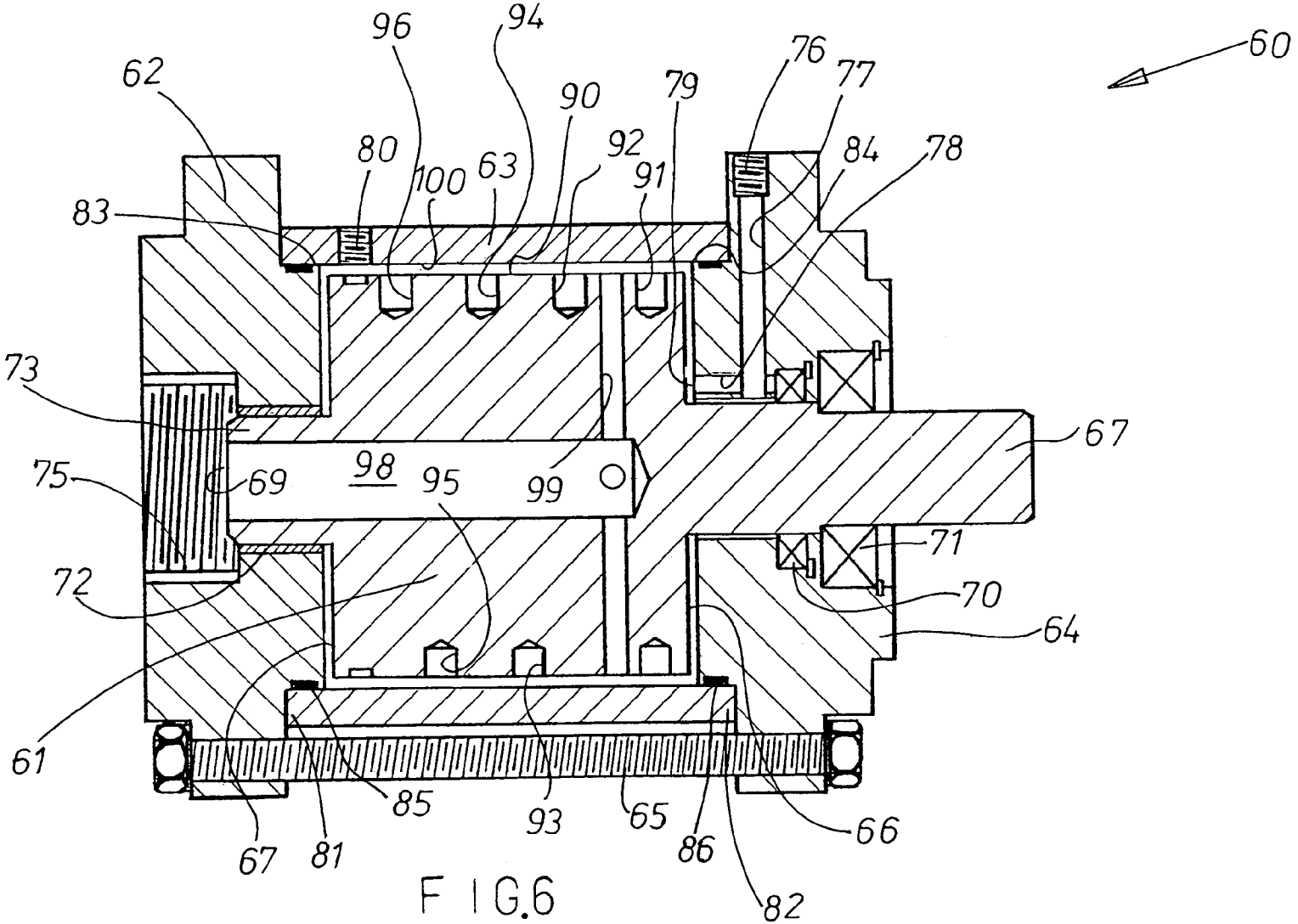
FIG. 6 is a longitudinal sectional view of a device in according to the second embodiment of the present invention.

In FIG. 6, the device 60 has a cylindrical rotor portion 61 disposed in an internal chamber formed by three-piece housing structure comprising members 62, 63, 64, and where the members are held together by means of studs 65. Drive shaft portion 62 extending from end face 66, and where seal 70 and bearing 71 in housing member 64 surrounds shaft portion 62. At the opposite end 67 of rotor portion 61, a further bearing 72 is provided which surrounds inner shaft 73, bearing 72 located in housing member 62 and where housing member 62 is provided with an intake or inlet fluid connection 75 for fluid 'A'. Housing member 64 is similarly provided with an intake or inlet connection 76 for fluid 'B' and where passages 77, 78 direct fluid 'B' through inlet port 79 towards that portion of internal chamber adjacent rotor end face 66. Centrally located housing member 63 being a sleeve may include at least one exit passage 80 for the departing fluids 'A+B' mixture. The respective ends 81, 82 of sleeve 63 rest on registration shoulders 83, 84 provided in housing member 62, 64 where respective seals 85, 86 are located.

Over the cylindrical surface 90 of rotor 61 there are a formation of six rows of bottom-ended holes shown as rows 91, 92, 93, 94, 95 and 96.

The end face of shaft portion 73 is provided with an entrance port 69 which is the entrance to longitudinal passageway 98 for receiving fluid 'A' from inlet 75. Longitudinal passageway 98 is connected with one or more radial passageways 99 in the interior of rotor portion 61. Fluid from inlet 75 therefore travels along longitudinal passageway 98 and radial passageways 99 to reach the working clearance between bore 100 and rotor 61 exterior surface 90.

The first row of bottom-ended holes 91 nearest end face 66 of rotor portion 61 are disposed between the inlet port 79 for fluid 'B' on the one hand and radial passageways 99 for fluid 'A' on the other hand.

Fluid 'B' becomes subjected to fluid turbulence generated by this first row of bottom-ended holes 91 before travelling towards radial passageways 99, where fluid 'A' enters the annular working clearance. The combined fluids 'A' and 'B' commence mixing as soon as they collide in the general vicinity of radial passageways 99 flowing together in a general direction towards rotor end face 67.

Mixing between fluids 'A' and 'B' continues as they flow in a general direction towards rotor end face 67, the mixture becoming more refined as each row 92, 93, 94, 95 and 96 of bottom-ended holes is traversed in turn, and once reaching circumferential groove 100, the fluid mixture 'A+B' can leave the device 60 via fluid exit 80.

DETAILED DESCRIPTION OF THE THIRD ILLUSTRATIVE EMBODIMENT OF THE INVENTION

Figure 7:
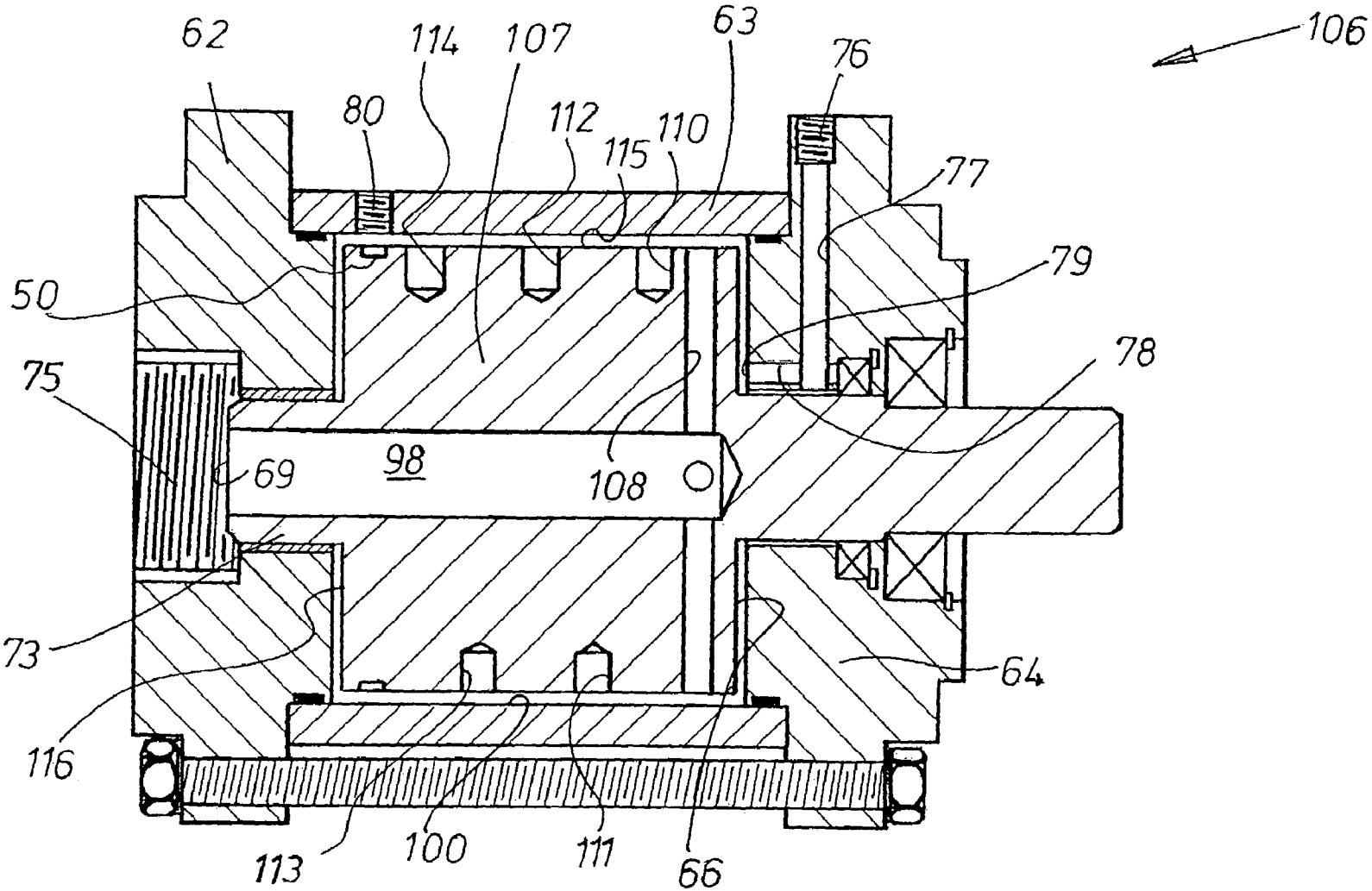
FIG. 7 is a longitudinal sectional view of a device in according to the third embodiment of the present invention.

The device 106 in FIG. 7 differs in only one major respect to the second embodiment, and description is therefore only necessary to show the main points of difference between these two embodiments of the invention. Furthermore, as many of the components are identical to those described for the second embodiment, they carry the same reference numeral.

As for the previous embodiment, an entrance port 69 provided on the face of shaft portion 73 opens to interior longitudinal passageway 98 provided for receiving fluid 'A' from inlet 75. Longitudinal passageway 98 connects with radial passageways 108 in the interior of rotor portion, here given reference numeral 107.

Radial passageways 108 are positioned near to the end face 66 of rotor portion 107 without there being any intervening row of bottom-ended holes as for earlier embodiments. A number of rows of bottom ended holes, shown as rows 110, 111, 112, 113, 114, are deployed over the remaining cylindrical surface 115 of rotor 107 between these radial passageways 108 and end face 116.

Fluid 'B', arriving into the device 106 at inlet 76, travels through passages 77, 78 to inlet port 79 to enter that sector of the internal chamber adjacent inlet port 79 and face 66. As fluid 'B' enters the annular working clearance between bore 100 and rotor surface 115, mixing between the fluids can occur as soon as fluid 'B' has travelled the short distance to where fluid 'A' enters the working clearance from radial passageways 108.

Both fluids collide in the general vicinity of where radial passageways 108 meeting the working clearance, and fluid mixing commences. The mixture becomes more refined as the two fluids move across the cylindrical exterior 115 of the rotor portion 107 where they are subjected to cavitational induced turbulence caused by rows 110, 11, 112, 113, 114 of bottom ended holes. For waste water clarification, it is to be preferred for waste water to enter the device at inlet 75 whereas piped air would enter at inlet 76. In this case, the oxygen dispersed into the form of very fine bubbles in the water leaves the device 106 at exit 80.

DETAILED DESCRIPTION OF THE FOURTH ILLUSTRATIVE EMBODIMENT OF THE INVENTION

Figure 8:
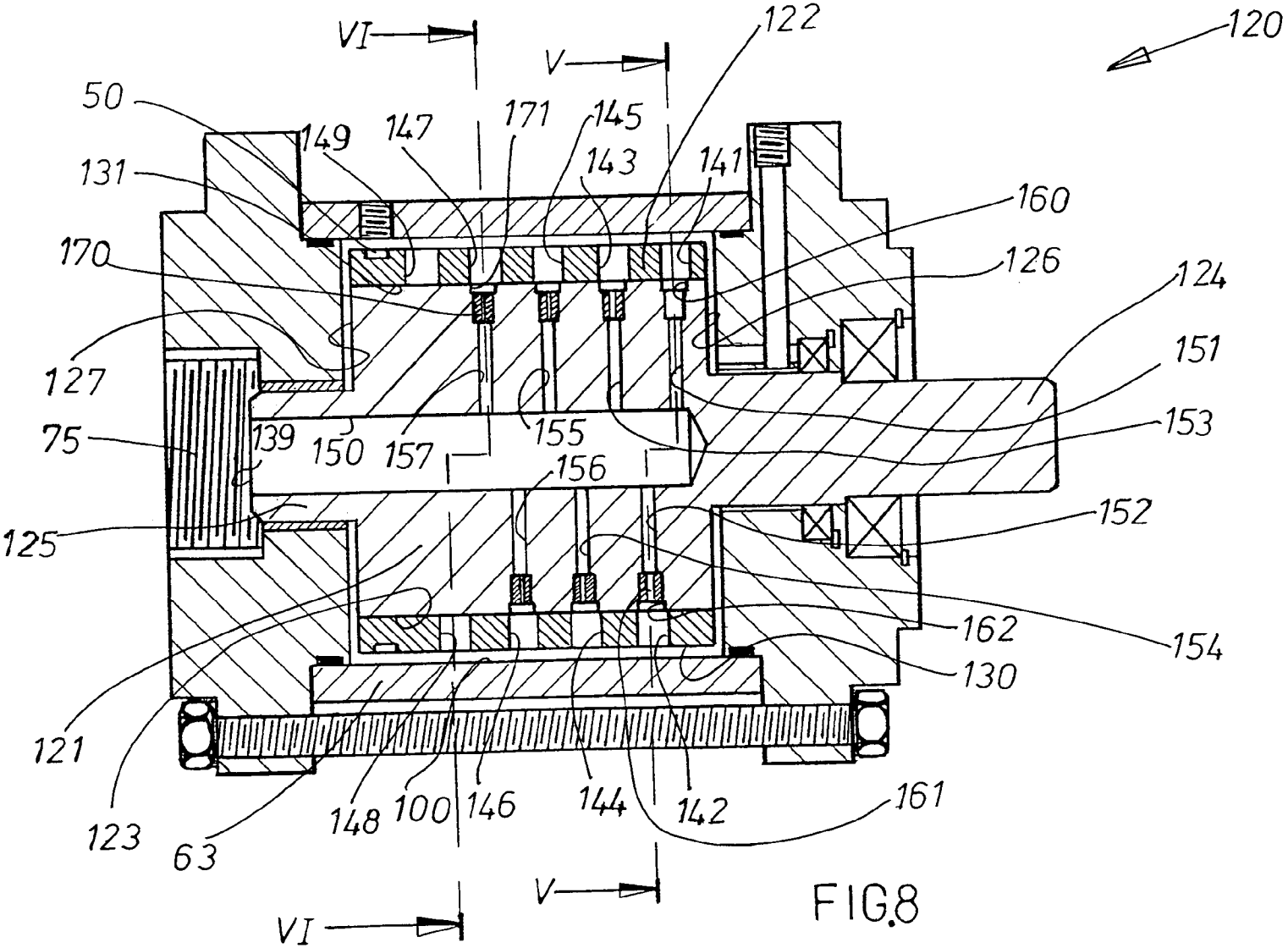
FIG. 8 is a longitudinal sectional view of a device in according to the fourth embodiment of the present invention.

The device 120 in FIG. 8 differs in only one major respect to the earlier embodiments of the present invention, and description is therefore only necessary to show the main points of difference with many of the components that are identical carrying the same reference numeral. Rotatable unit here comprises two elements 121, 122, the first being termed the central body element 121 having a cylindrical surface 123 and two integral shaft portions 124, 125 extending from respective end faces 126, 127. The second, element of the rotatable unit and termed the rotor sleeve element 122, has an external cylindrical surface 130 which confronts the bore 100 of central housing member 63, and an internal surface 131 which is seated on cylindrical surface 123 of central body element 121. There should be a reasonably tight fit between the elements 121, 122 and where suitable retaining means such as screws can be used to tie them together so they rotate at equal speed, although as shown, element 122 is shown as a heat-shrink fit on element 121.

Figure 10:
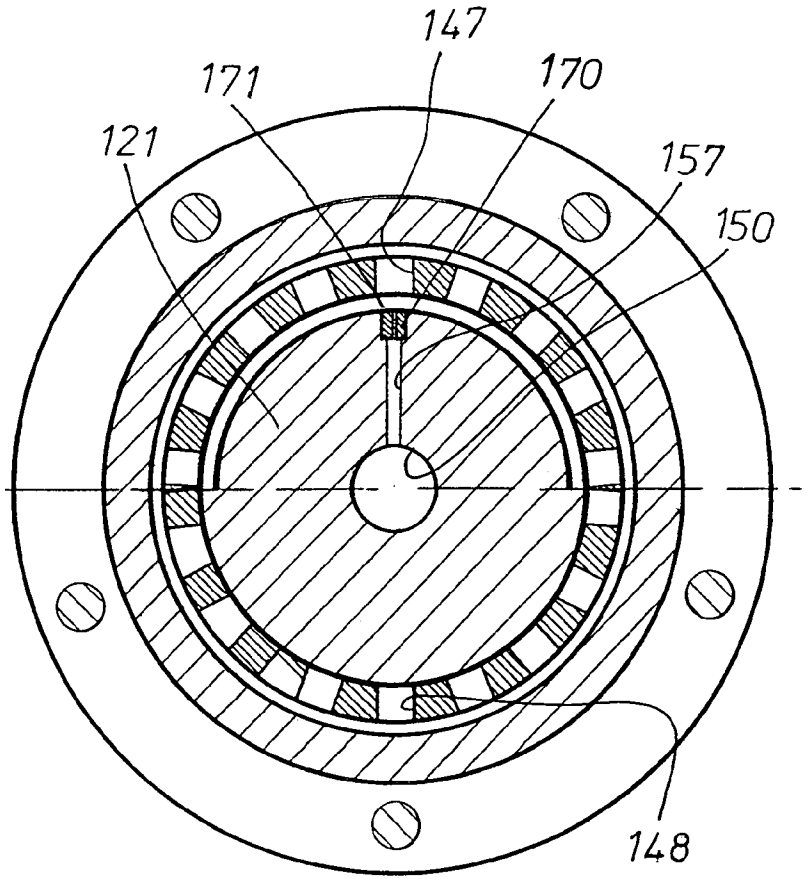
FIG. 10 is a transverse sectional view of the device taken along line VI-VI in FIG. 8.
Figure 9:
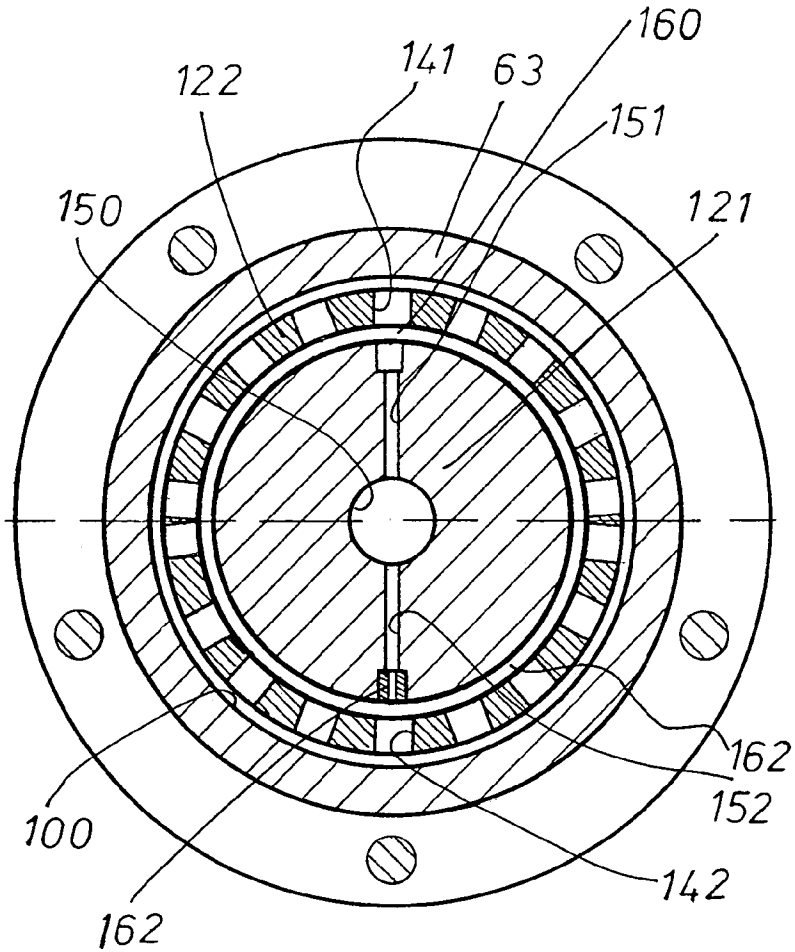
FIG. 9 is a transverse sectional view of the device taken along line V-V in FIG. 8.

Rotor sleeve element 122 contains nine rows of through-holes numbered as holes 141, 142, 143, 144, 145, 146, 147, 148 and 149, starting with row 141 nearest face 126 and ending in row 149 nearest face 127. Central element 121 is provided with an entrance port 139 leading to interior longitudinal passageway 150, and where entrance port 139 receives fluid 'A' from inlet 75. A number of radial holes 151, 152, 153, 154, 155, 156, 157 are located in central element 121, all these holes 151-157 communicating with longitudinal passageway 150 to allow fluid 'A' to travel to, depending on the application, to certain chosen rows of through-holes in rotor sleeve element 122. In the given format chosen here as an example, FIG. 9 shows how radial hole 151 is connected by circular groove 160 to the first row of through-holes 141, whereas the next adjacent radial hole 152, arranged to be in series with a flow control element 161, is connected by circular groove 162 to the second row of through-holes 142. The flow control element 161 acts as a throttle, the purpose of which is to ensure that for any given row of holes where a throttle is present, there is a restriction in the amount of fluid that can flow across the throttle, and due to the pressure drop, ensuring the amount of fluid 'A' from longitudinal passageway 150 reaching that particular row of through-holes is controlled. Depending on what pressure levels are present in the fluids arriving at the respective inlets, the flow control element 161 can operate as fluid injectors, and by continuously injecting a quantity of fluid into a respective row of holes so that in additional to the cavitational effect created by the holes on the liquid in the working clearance, the short-circuit of liquid received in the working clearance via the holes creates additional fluid disturbance within the fluid mixing region. For the sake of simplicity, all the flow control elements such as 161, 170 are now termed as the 'throttled fluid injectors'. For instance, FIG. 10 shows radial hole 157, in series with throttled fluid injector 170, connected to circular groove 171 to the seventh row through-holes 147. Preferably, the size of fluid delivery hole in each throttled fluid injector becomes progressively smaller the closer the respective row of holes is positioned closer are to inlet 75.

FIG. 10 also shows, by way of example, an additional eighth row of through-holes 148, performing the same function as the earlier described bottom-ended holes in previous embodiments. Through-holes 148 become bottom-ended holes due to being blanked off by the exterior cylindrical surface 123 of central element 121. As shown, the same is also true for the ninth row 149. However it should be noted that eighth and ninth row of through-holes 148, 149 as well as first row 141, with the addition of further flow control elements 161 positioned in central element 121, could also, if required, be fluidly short-circuited via a respective radial hole to longitudinal passageway 150.

Fluid 'B' travelling through passages 77, 78 to inlet port 79, once past end face 126, enters the annular working clearance between bore 100 and external cylindrical surface 130 of rotor sleeve element 122. Mixing commences as soon as fluid 'B' travels the short distance to where fluid 'A' enters the annular clearance via radial hole 151, circular groove 160, and first row of through-holes 141. In the event that the first row of through holes where blanked off in the manner of rows seven 148 and eight 149, the device 120 would then first cause turbulence to fluid 'B' before it reached fluid 'A' in a manner already described for first and second embodiments.

As fluid 'A' and fluid 'B' move progressively travel in the direction towards circumferential groove 50, both fluids are subjected to more fluid turbulence by reason of both additional turbulence cause by progressively finer jets of fluid 'A' via the throttled fluid injectors such as those indicated by reference numerals 161, 171, as well as the cavitational influences imposed on the mixture due to blanked off holes 148, 149 in rows seven and eight. The mixed fluid 'A+B' leaves the annular clearance at exit 80. For ease of servicing the unit, compressed can be blown into inlet 75, the air passing through the numerous passageway and groove connections communicating longitudinal passageway 150 to annular clearance between surface 130 and bore 100, and any debris that may have collected in the holes of the various rows 141-149 during operation may therefore be easily removed.

DETAILED DESCRIPTION OF THE FIFTH ILLUSTRATIVE EMBODIMENT OF THE INVENTION

Figure 11:
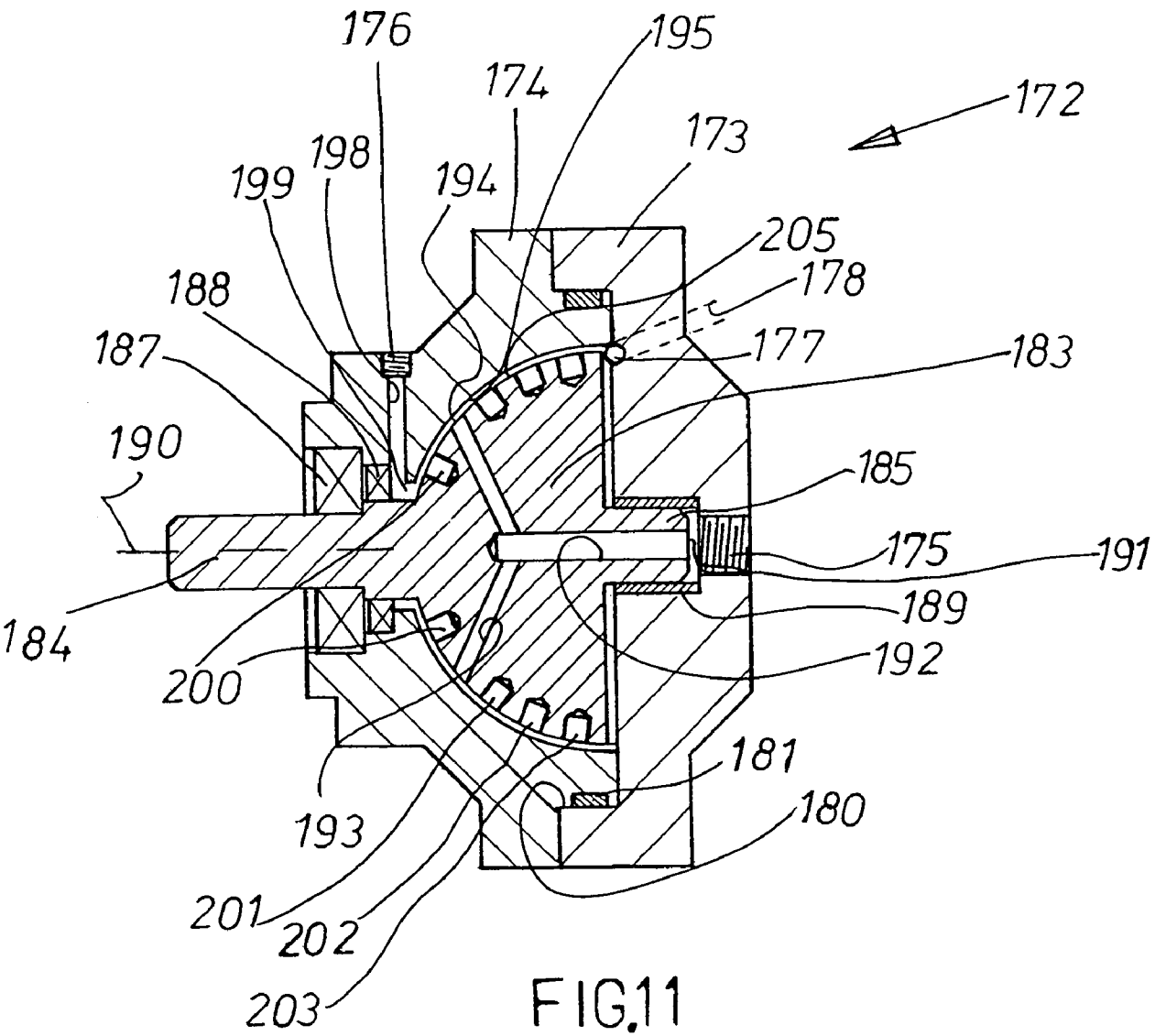
FIG. 11 is a longitudinal sectional view of a device in according to the fifth embodiment of the present invention.

Referring to FIG. 11, the device 172 has a housing structure comprising two members 173, 174 surrounding an internal chamber. Housing member 173 includes a centrally located inlet passageway 175 for one of the fluids and housing member 174 includes inlet passageway 176 for the other of the fluids to be introduced and mixed within the device. Housing member 173 also includes transverse fluid exit passageway 177 from where the combined mixture leaves the device 172 shown as dotted line 178. Housing elements 173, 174 are held together by bolts (not visible), and connect at a register 180 with a seal 181 disposed at the register to prevent fluid loss from the interior of the device.

As with earlier embodiments, the rotor and drive shaft are an integral rotating unit, hence the rotor portion, protruding shaft portion and inner shaft portion receive the respective reference numerals 183, 184, 185. Housing member 174 receives a bearing 187 and a seal 188 which surround protruding shaft portion 184, and housing member 172 receives bearing 189 to support inner shaft portion 185.

Rotor portion 183, protruding shaft portion 184 and inner shaft portion 185 are rotatable as a unit on longitudinal axis 190. Alternatively, should the rotor and drive shaft be manufactured as two separate components, the rotor would preferably be provided with a central hole with its center coincident with axis 190, and the drive shaft would extend through this hole to support the rotor and be, for instance, connected together to transmit driving torque to the rotor by means of a spine.

Fluid 'A' may enter the device 172 through inlet 175, the inner shaft portion 185 being provided with an entrance port 191 leading to longitudinal passageway 192, and the fluid flows along longitudinal passageway 192 before being directed by one or more angled passageways 193 that open at 194 on the surface exterior 195 of the rotor portion 183.

Fluid 'B' enters the device 172 at inlet 176 and travels down drilled passage 198 to reach pocket 199 which lies adjacent the smaller diameter end of rotor portion 183 and which is in spaced separation from openings 194 for fluid 'A' by a circular row of bottom-ended holes 200. The interior of housing member 174 is provided with a female hemi-spherical surface 205, and where rotor portion 183, having a similarly shaped male hemi-spherical surface 195, is in spaced separation from this surface 205 so that the working clearance between these surfaces 195, 205 forms a pathway, also known as fluid passage gap region, for the fluids to travel in a direction towards fluid exit 177. As shown, this clearance height is of constant value over the entire distance between surfaces 195, 205, but could alternatively, be arranged to diverge or converge in size in relation to the increasing rotor radial dimension. The centre point chosen by the creator of the device along axis 190 from which the respective hemispherical shapes are generated determines the gap height. The circular row of bottom-ended holes 200 cause turbulence conditions in fluid 'B' through the occurrence of cavitation which help in the mixing between the fluids as soon as fluid 'B' has completed it movement along the pathway to arrive and meet the incoming fluid 'A' entering the fluid passage gap region through openings 194 in rotor portion 183.

Further circular arrays of bottom-ended holes denoted by reference numerals 201, 202, 203 causing further fluid turbulence through cavitation, further refining the mixing of fluids 'A' and 'B' as they flow together towards fluid exit 177.

As in the case of earlier embodiments, exit passage 177 for the fluid mixture lies at a greater radial distance from rotation axis 190 as compared to fluid inlet 175 for one of the fluids. This is a further preferred feature of the invention, namely that the rotating rotor transmits a momentum to the fluid arriving at openings 194 such that on arrival into the clearance between surfaces 195, 205 promotes the tendency to flow in the general direction towards the exit 177 and not towards pocket 199 where the other fluid type enters the working chamber of the device 172.

DETAILED DESCRIPTION OF THE SIXTH ILLUSTRATIVE EMBODIMENT OF THE INVENTION

Figure 12:
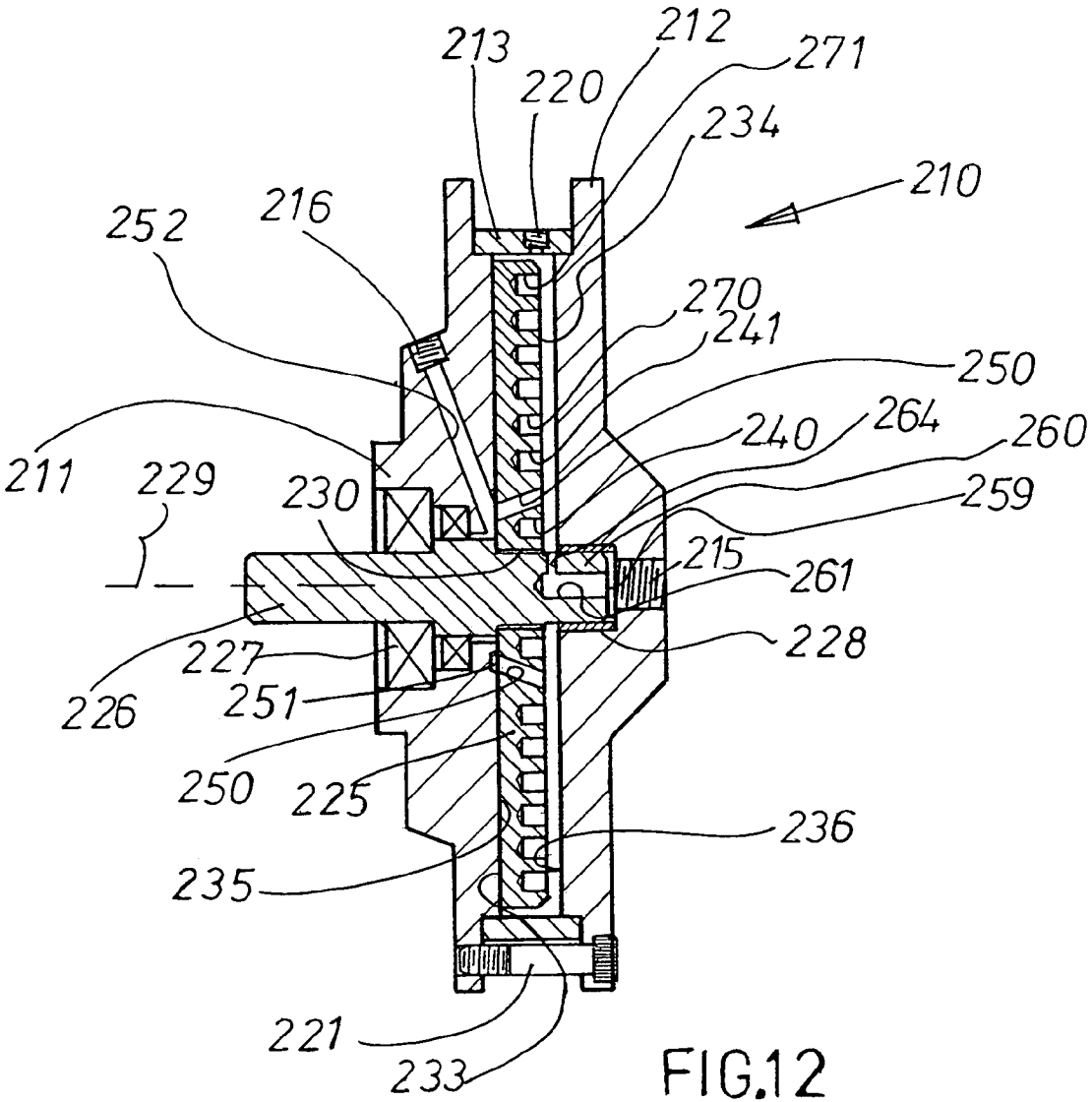
FIG. 12 is a longitudinal sectional view of a device in according to the sixth embodiment of the present invention.

Referring to FIG. 12, the device 210 has a housing structure comprising three members 211, 212, 213 forming an internal chamber. Housing member 212 includes a centrally located fluid input inlet 215 for one of the fluids and housing member 211 includes fluid input inlet 216 for the other of the fluids to be introduced to device. The third housing member 213 includes a radially positioned fluid output exit 220 from where the combined mixture leaves the device. A series of screws 221 hold housing member 213 sandwiched between front and back housing members 211, 212. Rotor element 225 disposed in internal chamber is supported on drive shaft 226, and where bearings 227, 288 in respective housing members 211, 212 support drive shaft 226. Drive shaft 226 is mechanically connected to rotor disc element 225 by splines denoted by reference numeral 230, and both rotor element 225 and drive shaft 226 rotate about rotational axis 229.

Rotor element 225, preferably as shown circular in shape having respective end faces 233, 234, is formed with a plurality of openings in the form of several circular rows of bottom-ended holes over face 234, the innermost circular row of holes being denoted by reference numeral 240, and the next adjacent row by reference numeral 241. Between these adjacent rows 240, 241, a number of passageways 250 are provided in rotor element 225 and which are angled slightly with respect to the axis 229. Face 233 of rotor element 225 is quite close to the interior wall 235 of housing member 211 but not touching, and passageways 250 are fluidly arrange to communicate with a circular groove 251 formed in housing member 211. Inlet 216 and circular groove 251 are fluidly connected together by drilled hole 252 in housing member 211. As only a very small clearance exists between disc 225 and housing member 211, the majority of the fluid arriving in circular groove 251 must travel via passageways 250 to reach the opposite side of the rotor where the clearance between it and housing member 212 is greater. The purpose of passageways 250 is therefore to allow that fluid, for instance here designated as fluid 'B', arriving in circular groove 251 from inlet 216 via drilled hole 252 to pass through the interior of rotor element 225 and reach the space on the opposite side of the rotor element between face 234 and interior wall 236 of housing member 212. Face 234 of rotor element 225 is spaced from the interior wall 236 and the fluid arriving through passageways 250 arrives in this space in-between the innermost circular row of holes 240 and the next adjacent row of holes 241.

The other, fluid, for instance here designated as fluid 'A', enters the device 210 via inlet 215, flows through an entrance 259 at the inner end 260 of drive shaft 226 into longitudinal passageway 261, arriving via radial hole 264 at the space radially inwards of rows of holes 240 between face 234 and wall 236. In this example, the fluid type 'A' has to transverse across the first array of holes 240 before it may meet and mix with fluid 'B' arriving via the interior of the rotor through passageways 250.

Turbulence in the fluid 'A', caused by the row of holes 240, acting together by the motion imparted to fluid 'A' by nature of the spinning rotor element 225 propels the fluid radially outwards where it impacts the streams of fluid 'B' arriving from passageways 250. Initial mixing between fluid 'A' and fluid 'B' occurs radially inwards of row of holes 241 and the resulting initial mix is carried radially outwardly between the spinning face 234 of the rotor element 225 and the static housing member 236. The mixing of fluids 'A' and 'B' continues as they become subjected to further turbulence imparted by cavitational influences occurring around further rows of holes radially outwardly of holes 241, the next adjacent row here designated as 270 and cumulating with the outermost row designated as 271. The resulting refined mixture fluids 'A+B' collecting radially outwards to rotor disc 225 exits the device 210 through exit connection 220.

DETAILED DESCRIPTION OF THE SEVENTH ILLUSTRATIVE EMBODIMENT OF THE INVENTION

Figure 13:
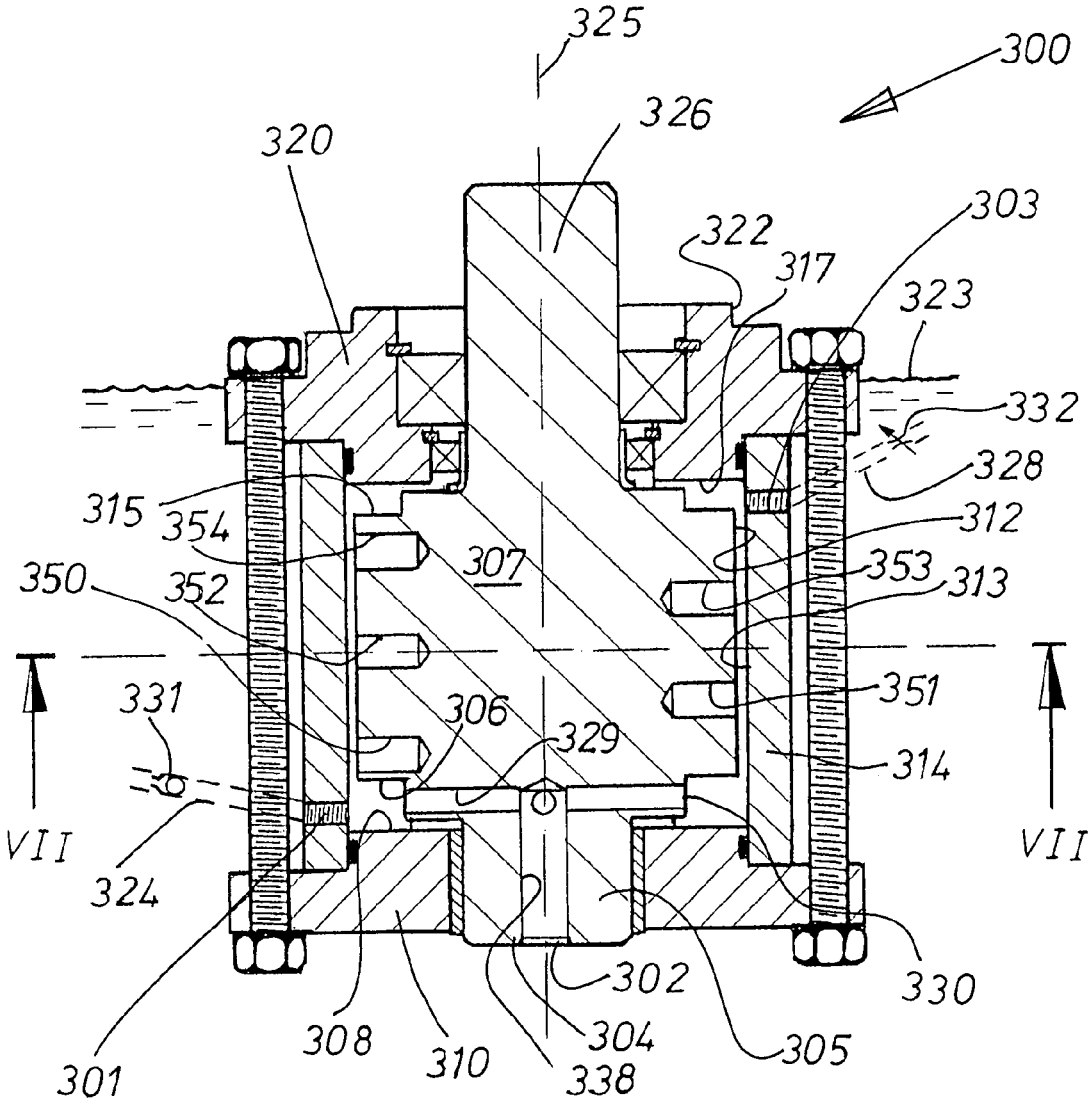
FIG. 13 is a longitudinal sectional view of a device in according to the seventh embodiment of the present invention.
Figure 14:
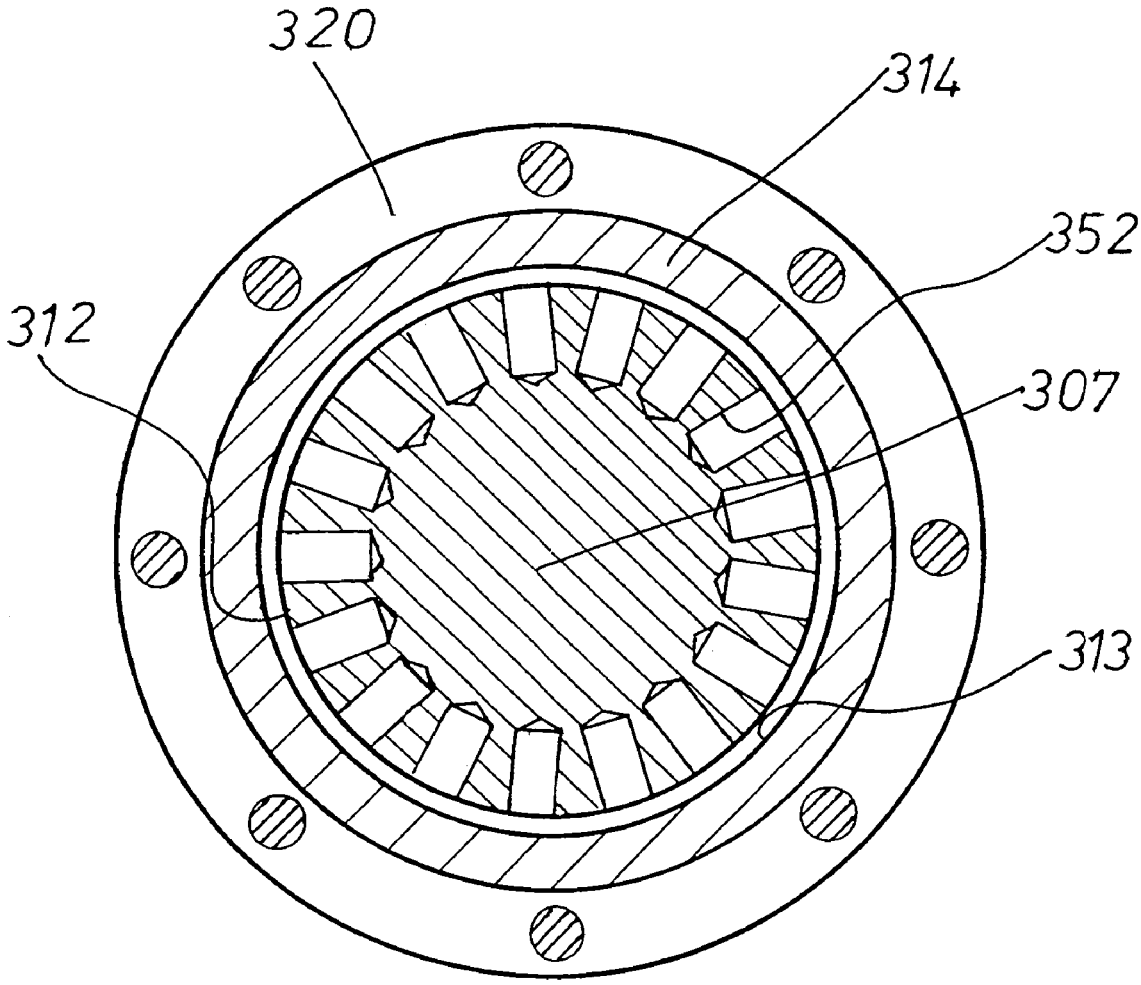
FIG. 14 is a transverse sectional view of the device taken along line VII-VII in FIG. 13.

With respect to this embodiment, the device 300 in FIGS. 13 & 14 includes a number of subtle differences over earlier embodiments. Respective numerals 301, 302, 303 are used to indicate the two fluid entry points, and the fluid exit point, and as one difference over earlier embodiments, fluid entry point 302 is placed directly at the face end 304 of the inner portion 305 of the drive shaft.

As further differences, first and second sub-regions of the inlet region lie adjacent the side of the end face 306 of rotor 307 of the rototable unit and the interior wall 308 in housing member 310, and the fluid exhaust region lies adjacent the opposite end face 315 and wall 317. Mixture 'A+B' on reaching the exhaust region leaves the device 300 at fluid exit 303.

The mixing region for fluids 'A' and 'B' can now encompass the entire length of the rotor exterior surface 312, which is shown lying radial spaced of bore 313 in central housing sleeve 314.

Device 300, operating in a vertical sense about axis 325, shows the centrally located rotor 307 in the internal chamber formed by surrounding housing members 310, 314, 320. The externally protruding drive shaft portion 326 of the rotatable unit may be driven by an electric motor, the motor being mounted either directly on mounting flange 322 or preferably via a bell housing. Shown as fluid level 323, the bulk of device 300 remains submerged under the surface of fluid in the surrounding reservoir (not shown). As therefore, the greater part of the housing structure surrounding rotor 307 remains submerged in the fluid reservoir, respective pipes, shown by dotted-lines 324, 328, connect inlet 301 and exit 303, respectively, to the fluid circuit intended for the device 300.

The fluid entry point 302, here formed as an entrance port in shaft portion 305, and by reason of being positioned below fluid level 323 in the reservoir, can draw fluid 'A' directly from the reservoir. Entrance port 202 leading to longitudinal passageway 338 allows fluid 'A' to reach one or more radial passageways 339 internally disposed in rotor portion 307. Passageways 339 open at openings 330 the first sub-region of the inlet region lying adjacent rotor end face 306 and interior housing wall 308. Fluid 'B', flowing in pipe 324 to inlet 301, enters the device 300 at the second sub-region of the inlet region at bore 313 and axially spaced between rotor end face 306 and housing interior wall 308.

In practice, both inlet 301 and outlet 303 would be angularly displaced from the positions shown to avoid their respective pipes interfearing with studs holding the housing structure together. Also as shown, pipe 324 may include a check valve denoted by reference numeral 331 in order to safeguard against reverse flow conditions, whereas pipe 328 if required, be fitted with a variable flow control valve denoted by reference numeral 332 allowing the flow rate through the device 300 to be adjusted.

Therefore with this embodiment of the present invention, fluids 'A' and 'B' collide together in the volume space defined by radially by bore 313 of the internal chamber, and axially on the one side by rotor end face 306, and on the other side by housing interior wall 308. This volume space is the inlet region for this particular embodiment, and unlike earlier embodiments, contains both the first and second sub-regions of the inlet region. On leaving the inlet region, the fluids pass through the annular clearance between bore 313 and rotor exterior surface 312, travelling over the entire length distance of rotor exterior surface 312, becomes more refined as mixture as they continue being subjected to cavitational disturbances imposed by a series of bottom-ended holes shown as row holes 350, 351, 352, 353, 354 that extend across the mixing region.

The fluid mixture 'A+B', on entering the exhaust region, leaves the device 300 at exit 303. When used for waste water clarification, with this embodiment it is envisaged that waste water would enter the device 300 at entrance passage 302, and pressurized air would enter the device 300 at inlet 301. The initial mix would occur in the first and second sub-regions of the inlet region before the fluids travel over the cylindrical exterior surface of the rotor where the groupings of bottom-ended holes are disposed. Although not shown, longitudinal passageway 338 may extend deeper into the interior of the rotor 306 to connect with respective rows of bottom-ended holes, with or without an intervening flow control element, in a somewhat similar manner as has already been described for the fourth embodiment of the present invention.

DETAILED DESCRIPTION OF THE EIGHTH ILLUSTRATIVE EMBODIMENT OF THE INVENTION

Figure 15:
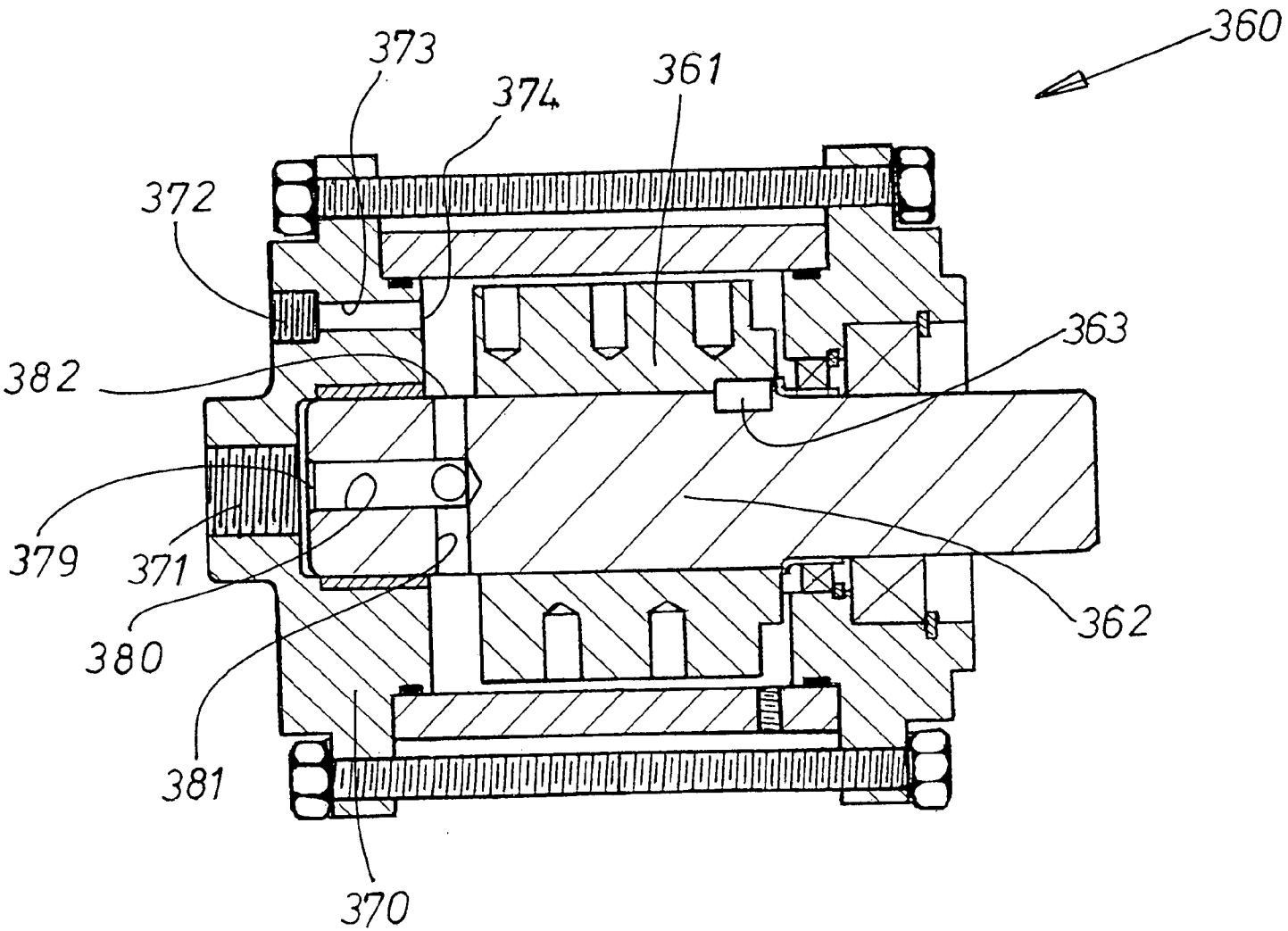
FIG. 15 is a longitudinal sectional view of a device in according to the eighth embodiment of the present invention.
Figure 16:
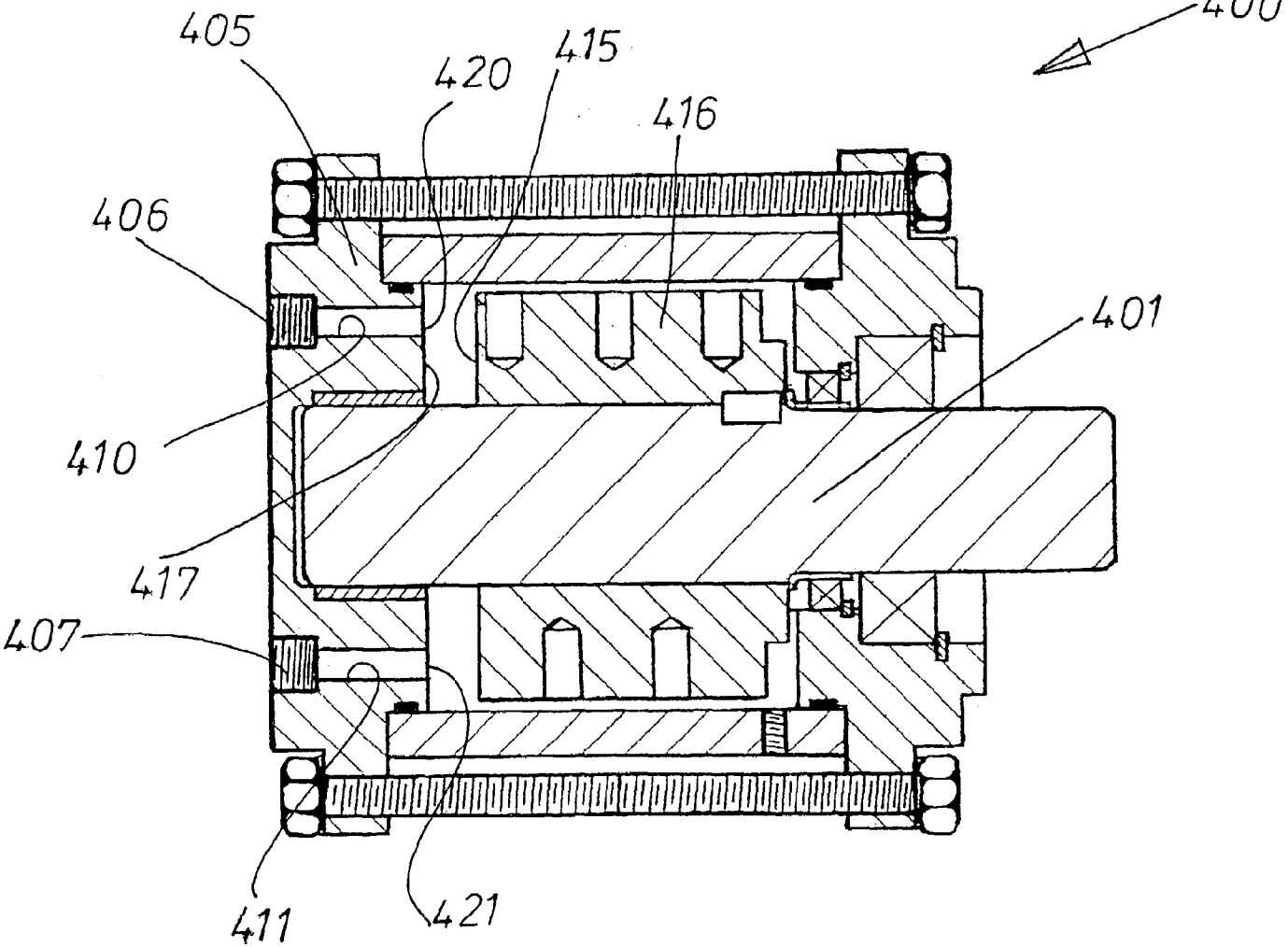
FIG. 16 is a longitudinal sectional view of a device in according to the ninth embodiment of the present invention.

With respect to this embodiment, the device 360 of FIG. 15 has a rotatable unit comprising a separate rotor element 361 and a separate shaft element 362, where a key or dog designated by reference numeral 363 is provided to transmit driving torque from the drive shaft 362 to the rotor 361. End housing member 370 is provided with two inlets, namely inlet 371 for fluid 'A' and inlet 372 for fluid 'B'. Inlet 372 is connected via passage 373 to the first sub-region in the neighbourhood of opening 374. Inlet 371 communicates via fluid entrance port 379 at the inner end of shaft 262, to travel along longitudinal passageway 380 and one or more radial passageways 381 to enter the second sub-region in the neighbourhood of opening 382. As was true for the last embodiment described above, fluid 'A' and fluid 'B' initially meet at this inlet region before passing through the working clearance where a series of bottom-ended holes are disposed on the rotor 361 cause the fluids to be mixed more completely.

DETAILED DESCRIPTION OF THE NINTH ILLUSTRATIVE EMBODIMENT OF THE INVENTION

As compared to the previous embodiment, here this device denoted by reference numeral 400 has a solid drive shaft 401 without any internal passageways. Here housing member 405 is provided with two fluid inlets, shown as respective inlets 406, 407 and which feed through a respective passage 410, 411 to the inlet region that lies between end face 415 of rotor 416 and interior wall 417 of housing 405. The space adjacent opening 420 of passage 410 may be called the first sub-region of the inlet region whereas the space adjacent opening 421 of passage 411 may be called the second sub-region of the inlet region. Note that in this example, the drive shaft 401 does not penetrate through housing member 405. Although inlets 406, 407 are radially spaced from drive shaft 401 by approximately the same distance, as a general rule, preferably the denser of the two fluids arriving at its particular inlet sub-region should be the one entering the machine at or as near as possible to the rotational axis of the rotor. However, is not intended to limit this invention to this one operational mode.

Furthermore, in the case of waste water clarification, an initial waste water and air mixture may well be piped to one of the inlets for mixing internally in the device with waste water arriving at the other inlet. With the use of chlorine as a water disinfectant becoming more controversial, it is envisaged that the present invention can also be used for such applications as swimming pools. By introducing the gas ozone to one of the inlets, viruses carried in the water can be take care of. Bacteria on the other hand by either copper or silver plating of the rotor exterior surface over which the arrays of bottom-ended holes are located, or the surrounding housing sleeve, would produce a sacrificial surface exposed to gradual erosion by cavitation. By exploiting the algaecide, bactericidal and microbicidal potential of the ions of the metals silver and copper, it is envisaged that a separate pump would be used to delivery water to the device and the device would deliver the water and ozone mixture to a typical filter containing sand where the flocculate and the enclosed impurities would be retained. Also for instance, the rotor sleeve element of the fourth embodiment would be manufactured from copper. Alternatively, the sleeve housing element could be drilled in one or more places to accept at least one threaded probe, the probe typically would have sufficient length to penetrate the full skin thickness of the sleeve as well as protrude into the working clearance between rotor and sleeve. The end of the probe would be close to the surface of the rotor without touching and be provided with a sacrificial material. The occurrence of cavitation in the working clearance would gradually remove material away from the surface of the probe and which would be deposited as very small particles in the filter or pool water. Once the probe material has been lost, it is then an easy task to replace the probe. They may also be an electro-potential applied across the probe(s) and rotor.

In accordance with the patent statutes, I have described the principles of construction and operation of my invention, and while I have endeavoured to set forth the best embodiments thereof, I desire to have it understood that obvious changes may be made within the scope of the following claims without departing from the spirit of my invention.

The invention claimed is:

1. An apparatus for the mixing of two or more dissimilar fluids together comprising a housing having a chamber and first and second fluid inlets and a fluid outlet in fluid communication with said chamber, one of said dissimilar fluids entering said chamber at one of said inlets and the other of said dissimilar fluid entering said chamber at the other one of said inlets, said first and second fluid inlets and said fluid outlet each opening exteriorly of said housing;

a rotatable unit disposed centrally in said chamber and mounted for rotation within said chamber about an axis of rotation, said rotatable unit and said chamber defining an inlet region having first and second sub-regions, an exhaust region and a fluid mixing region, wherein said rotatable unit is provided with at least one circumferential row of bottom-ended holes formed on a face thereof, said fluid mixing region providing a unidirectional pathway for said dissimilar fluids upon entering said inlet region to reach said fluid outlet via said exhaust region, and said fluid outlet being nearer a distal end of said rotatable unit than said at least one circumferential row of bottom-ended holes;

said rotatable unit further comprising a port formed on a face thereof, said port communicating with internally disposed fluid passageways disposed in said rotatable unit, said fluid passageways comprising a longitudinal passageway and a radial passageway, said radial passageway communicating with said second sub-region to supply one of said dissimilar fluids to said fluid mixing region, the supply of the other of said dissimilar fluids to said fluid mixing region being via said first sub-region, said first sub-region being nearer the proximal end of said rotatable unit than said second sub-region, said port being in fluid communication with one of said first and second fluid inlets and the other of said first and second fluid inlets being in fluid communication with said first sub-region, said radial passageway being spaced from the proximal end of said rotatable unit by said at least one circumferential row of bottom-ended holes and said at least one circumferential row of bottom-ended holes being intermediate said first and second sub-regions.

* * * * *